United States Patent [19]

Mackey

[11] Patent Number: 4,886,277

[45] Date of Patent: Dec. 12, 1989

[54] GOLF BALL

[75] Inventor: Gary T. Mackey, Argyle, Tex.

[73] Assignee: American Ball Manufacturing, Corp., Carrollton, Tex.

[21] Appl. No.: 225,259

[22] Filed: Jul. 28, 1988

[51] Int. Cl.[4] ..... A63B 37/14

[52] U.S. Cl. ..... 273/232

[58] Field of Search ..... 273/232, 183 C, 235 R; 40/327

[56] References Cited

U.S. PATENT DOCUMENTS

| | | | |
|---|---|---|---|
| 1,286,834 | 12/1918 | Taylor | 273/232 |
| 1,656,408 | 1/1928 | Young | 273/232 |
| 1,666,699 | 4/1928 | Hagen | 273/232 |
| 1,681,167 | 8/1928 | Bedlam | 273/232 |
| 1,716,435 | 6/1929 | Fotheringham | 273/232 |
| 2,002,726 | 5/1935 | Young | 273/232 |
| 2,106,704 | 2/1938 | Davis | 273/232 |
| 2,728,576 | 12/1955 | Martin et al. | 273/232 |
| 3,819,190 | 6/1974 | Nepela et al. | 273/232 |
| 4,090,716 | 5/1978 | Martin et al. | 273/232 |
| 4,141,559 | 2/1979 | Melvin et al. | 273/232 |
| 4,142,727 | 3/1979 | Shaw et al. | 273/232 |
| 4,258,921 | 3/1981 | Worst | 273/232 |
| 4,266,773 | 4/1981 | Treadwell | 273/232 |
| 4,560,168 | 12/1985 | Aoyama | 273/232 |
| 4,653,758 | 3/1987 | Solheim | 273/232 |
| 4,681,323 | 7/1987 | Alaki et al. | 273/232 |
| 4,720,111 | 1/1988 | Yamada | 273/232 |
| 4,722,529 | 2/1988 | Shaw et al. | 273/232 |
| 4,729,567 | 3/1988 | Oka et al. | 273/232 |
| 4,729,861 | 3/1988 | Lynch et al. | 273/232 |
| 4,765,626 | 8/1988 | Gobush | 273/232 |
| 4,772,026 | 9/1988 | Gobush | 273/232 |

*Primary Examiner*—George J. Marlo

*Attorney, Agent, or Firm*—Hubbard, Thurman, Turner & Tucker

[57] ABSTRACT

A golf ball is provided with evenly and uniformly distributed dimples so that at least four great circle paths on the surface of the golf ball do not intersect any dimples. The spherical surface of the golf ball is divided into fourteen geometric shapes, comprising six spherical squares and eight spherical hexagons. The arrangement of the dimples on the spherical surface is generally defined by the sides of the spherical squares and hexagons. The uniform distribution of dimples and great circle paths is such that the golf ball displays multiple axes of symmetry.

5 Claims, 3 Drawing Sheets

GOLF BALL

FIELD OF THE INVENTION

The present invention relates generally to golf balls and, more particularly to golf balls having an improved arrangement of dimples thereon.

DESCRIPTION OF THE PRIOR ART

The prior art in the area of golf balls is crowded, with a multitude of patents addressing practically every conceivable aspect of golf ball design and manufacture. Existing patents cover the materials used to make golf balls, the surface configuration of golf balls (i.e. the arrangement of the dimples), the configuration of the individual dimples, as well as various methods and apparatus for manufacturing golf balls. The particular references discussed herein deal primarily with the surface configuration of golf balls, since the present invention relates to a unique arrangement of dimples which has been heretofore undisclosed in the prior art.

The ultimate goal of the prior art patents dealing with surface configuration is, simply put, to improve the overall performance of the subject golf ball. Essentially, the performance of a golf ball is a direct function of the distance, accuracy, and consistency of the ball during normal play. If the size, weight, materials, and construction of golf balls are maintained relatively constant, the performance is dependent upon the size, shape, and location of the dimples of the surface of the ball. Of these three factors, the location of the dimples has proven to be extremely critical. Typical dimple patterns disclosed in the prior art are defined by the projection of regular polyhedra, or semi-regular polyhedra derived therefrom, onto the surface of a sphere, as discussed in detail below.

When a golf ball is struck by a golf club during play, the ball is rotated about an axis at high speed in a direction opposite the direction in which the ball would rotate if it were to be rolled along the ground in the direction of travel. This rotation is commonly referred to as "backspin" by persons conversant in golf ball performance.

The benefit of utilizing dimples in the surface of a golf ball is well known to persons skilled in the art of golf ball aerodynamics. The combination of dimples and backspin creates a pressure differential about the ball as it moves forward through the air. This pressure differential, in which the pressure of the air below the ball is greater than the pressure of the air above the ball, creates a condition referred to as "lift". Lift operates to counteract the force of gravity by pushing the ball upward as it travels through the air, thus increasing the performance of the golf ball by keeping it airborne longer. Therefore, it is well known in the art that golf balls with dimples generally travel greater distances than balls without dimples when struck with equivalent blows by a golf club.

The assembly of a golf ball generally involves molding a dimpled cover around a solid or wound core. Typically, the cover is either injection molded around a core suspended by locator pins within the two halves of the mold, or the cover is separately formed in two pieces which are compression molded around a core. Either method results in a cover comprising two hemispheres separated by a parting line formed at the meeting point of the two halves of the mold. It is most common in the art to utilize compression molding for golf balls with wound cores having either solid or liquid centers, and injection molding for balls with solid cores.

Golf balls with wound cores are typically referred to as "three piece" balls because they consist of three basic components: (1) a solid or liquid-filled center; (2) rubber winding around the center, and; (3) the cover. Similarly, solid core balls are referred to as having a "two piece" construction, since they consist solely of a solid core and a cover. A third type of ball, known as a "one piece" ball, is also known in the art. As the name suggests, one piece balls are solid balls of homogenous construction made by any conventional molding method suitable for the purpose. As with balls based on the two and three piece constructions, one piece balls also contain a parting line caused by the separation point necessary for the two halves of the mold.

The composition of the cover has also proven to be a factor in overall golf ball performance. Historically, three piece balls had covers made of natural or synthetic balata, or transpolyisoprene. While such balls are still in limited production, the majority of modern golf balls use two piece construction with covers made of a durable synthetic thermoplastic resin such as Surlyn, a product of E.I. duPont de Nemours Company, Incorporated. Since different golfers prefer different constructions and materials and the performance characteristics associated therewith, it is desirable for a golf ball to be adaptable to a variety of construction methods and materials.

Practical considerations dictate that the parting line between the two hemispheres of the cover is void of dimples and falls on a great circle or equator of the golf ball. U.S. Pat. No. 4,653,758 issued Mar. 31, 1987 to Solheim discloses an assembly method wherein the smooth surface void of dimples along the equator is eliminated by making the parting line jagged rather than straight. The Solheim configuration has apparently met with little commercial success, since the vast majority of golf balls in production today include a smooth equator. Since it is desirable for dimples to be arranged symmetrically in order to achieve optimum and consistent flight, the deviation from symmetry caused by a single smooth equator creates uneven air flow around the ball for different ball orientations.

It is well known to those skilled in the art that the performance of a golf ball is enhanced by placing the dimples in the most perfectly symmetrical arrangement that can be devised. Accordingly, the most common practice is to employ arrangements based upon the projection of the edges of a regular polyhedron upon the surface of a sphere, there being a limited number of polyhedra available for this purpose. Perhaps the most common polyhedron presently utilized for dimple arrangement is the icosahedron, as disclosed in U.S. Pat. No. 4,729,861 issued Mar. 8, 1988 to Lynch. Other polyhedra which have been used for this purpose are the dodecahedron and the octahedron, both of which are disclosed in U.S. Pat. No. 4,142,727 issued Mar. 6, 1979 to Shaw, et al.

In addition to the practical consideration of consistent performance achieved through a symmetrical dimple pattern, golf ball manufacturers generally strive for symmetrical patterns in order to comply with the specifications of the United Stated Golf Association (USGA). While the USGA rules do not specifically address dimple patterns per se, the rules do require that golf balls have substantially identical flight characteristics when rotated 90 degrees. This specification is commonly referred to as the "symmetry rule".

Dimple patterns based on the octahedron are among the oldest designs still in use. This dimple pattern has a particular advantage over some others because octahedral patterns repeat every 90 degrees and are therefore particularly adaptable to meeting the USGA symmetry rule. Octahedral designs also include a natural equator, thus providing an inherent location at which to separate the mold. Unfortunately, golf balls utilizing the octahedral design pattern generally have inferior aerodynamic properties due to the linearity of the arrangement of dimples, which does not result in optimum lift characteristics at the lower velocities encountered during the later segments of a typical flight. Accordingly, while the use of the octahedron as the basis for the dimple pattern provides certain advantages, the overall performance of golf balls using this pattern is exceeded by other prior art patterns.

Dimple designs based on the icosahedron, for example, yield golf balls with aerodynamic properties generally superior to those based on the octahedron. Consequently, dimple patterns based on the icosahedron are in widespread use in the golf ball manufacturing industry today. Icosahedral patterns, however, do not include a naturally occurring parting line when utilized with the preferred number of dimples, thus requiring careful manipulation of the dimples to accomodate current molding methods. The necessity of adapting the dimple pattern to include a smooth equator results in inconsistent flight performance with varying ball orientation. U.S. Pat. No. 4,560,168, issued Dec. 24, 1985 to Aoyama discloses one icosahedral pattern which attempts to solve this problem by subdividing each of the twenty triangular sides of the icosahedron into four sections, with great circles being inscribed along the boundary lines of the center sections. Therefore, golf balls manufactured pursuant to Aoyama have increased linear aerodynamic properties, but the pattern does not naturally repeat every 90 degrees. As pointed out above, repetition at 90 degree intervals is desirable to facilitate compliance with the USGA symmetry rule.

It is also known in the prior art to use semi-regular polyhedra for the dimple pattern in order to achieve improved aerodynamic properties while providing a plurality of great circles at which the two hemispheres may be joined. An example of such prior art is U.S. Pat. No. 4,729,567, issued Mar. 8, 1988 to Oka, et al, which discloses the use of the icosadodecahedron, a semi-regular polyhedron consisting of twenty identical triangles evenly distributed among twelve identical pentagons. This pattern is simply a derivative of, and substantially the same as, the icosahedral pattern, as clearly shown in FIGS. 7A, 8A, 9A, 10A, and 11A of the Aoyama reference discussed above. The icosa-dodecahedral configuration provides six naturally occurring great circles, which is desirable, but the dimple pattern imposed thereon does not repeat at 90 degree intervals, as with the icosahedral pattern from which it is derived. Therefore, in order to improve the flight consistency and comply with the USGA symmetry rule, the Oka device requires very specific sizes and placement of the individual dimples. In light of all of the considerations discussed above, the present invention was developed to maximize both the overall performance of the golf ball and the manufacturing simplicity associated therewith.

SUMMARY OF THE PRESENT INVENTION

An object of the present invention is to provide an improved golf ball having a dimple pattern which reflects a high degree of symmetry, at 90 degree intervals and otherwise. The unusually high degree of symmetry provided by the teachings of this invention allows for the even distribution of dimples about the surface of the ball, and allows for conformance with the USGA symmetry rule without requiring the use of dimples of varying sizes. It is also an object of this invention to provide a symmetric dimple pattern having multiple parting lines between the two hemispheres to facilitate construction of the improved golf ball.

Another object of this invention is to provide an improved golf ball dimple pattern suitable for use on balls of all conventional constructions, including one, two, and three piece designs. A further object of this invention is to provide a dimple pattern which improves the performance of the golf ball regardless of the materials used in the construction thereof.

In accordance with the teachings of the present invention, there is disclosed herein a preferred embodiment of a golf ball having a symmetrical dimple pattern with multiple parting lines. The unique dimple arrangement of this invention is accomplished by projecting onto a sphere a geometric prism consisting of six identical squares, and eight identical hexagons. As distinguished from the dimple patterns disclosed in the prior art, the pattern of this invention is not defined by either a regular polyhedron or a semi-regular polyhedron derived therefrom.

With the overall dimple pattern being defined by the adjoining squares and hexagons, dimples of varying or identical sizes are placed within the boundaries in a manner which provides for four great circles, or equators, which do not intersect any dimples. In the preferred embodiment disclosed herein, three different dimple sizes are utilized, and all dimples are located within the boundaries of the squares and hexagons. It will be understood by those skilled in the art, however, that the number and sizes of the dimples may be varied and the dimples may be placed on the boundary lines between the hexagons and squares without detracting from the improved performance provided by the present invention.

These and other objects of the present invention will become apparent from the reading of the following specification, taken in conjunction with the enclosed drawings.

DETAILED DESCRIPTION OF THE PREFERRED EMBODIMENT

Figure 1:
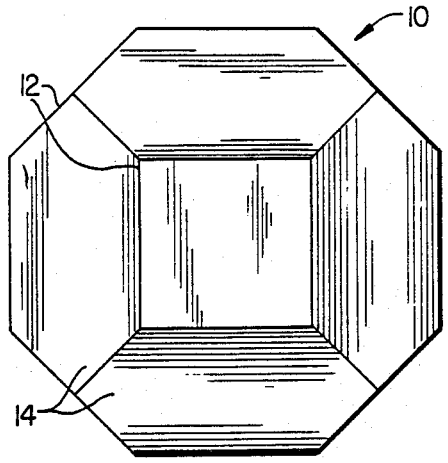
FIG. 1 is a front elevational view of the geometric prism used to define the dimple configuration of the present invention, the back elevational view being identical.
Figure 2:
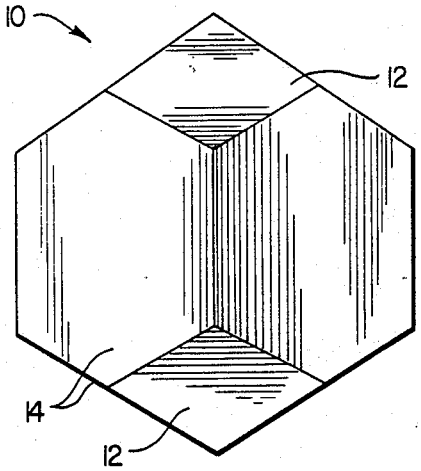
FIG. 2 is a side elevational view of the geometric prism of FIGURE 1, the opposite side elevational view being identical.

Referring now to the geometric prism 10 illustrated in FIGS. 1 and 2, the preferred embodiment of the present invention is accomplished by designing a semi-regular polyhedron having fourteen faces, said faces comprising six identical square faces 12 and eight identical hexagonal faces 14. As clearly shown in the drawings, each of said square faces 12 is contiguous with four hexagonal faces 14, while each of said hexagonal faces 14 is contiguous with three other hexagonal faces 14 and three square faces 12. With the geometric prism being projectable onto the surface of a sphere, the dimensions of the square and hexagonal faces are dictated by the dimensions of the sphere. In the case of the present invention, the sphere in question is a golf ball with dimensions controlled by the rules of the USGA.

Figure 3:
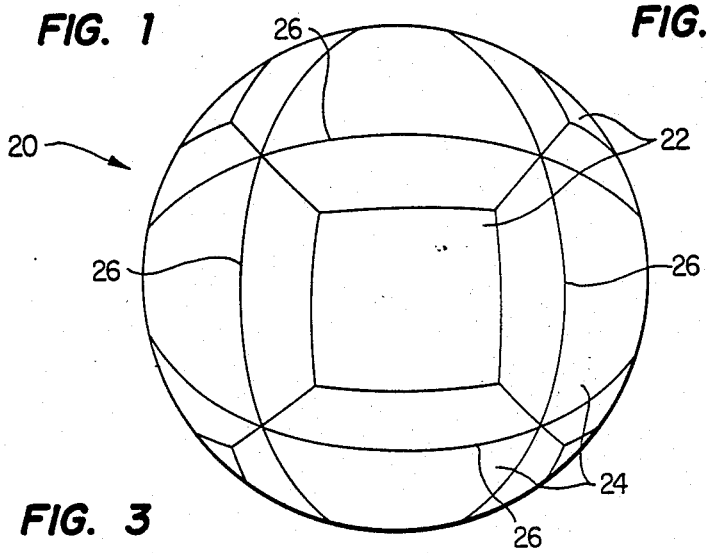
FIG. 3 is a front schematic view explanatory of how the geometric prism of FIG. 1 is projected onto the surface of a sphere with great circle paths being inscribed thereon.
Figure 4:
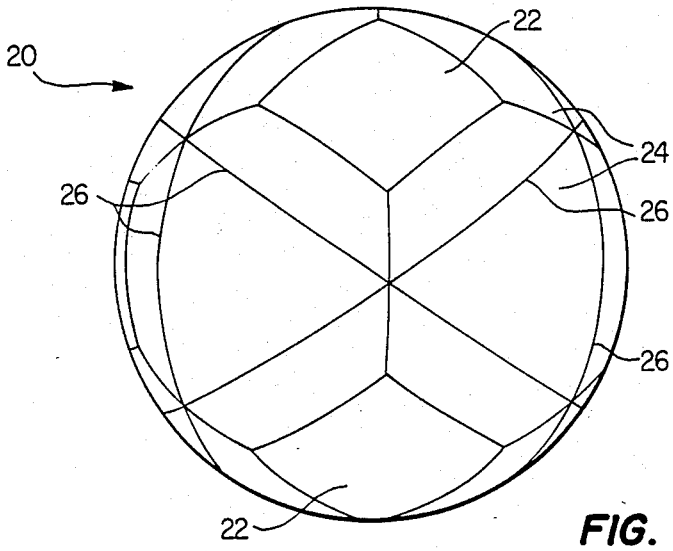
FIG. 4 is a side schematic view explanatory of how the geometric prism as depicted in FIG. 2 is projected onto the surface of a sphere having great circle paths inscribed thereon.

In FIGS. 3 and 4, the above described geometric prism 10 has been projected onto the surface of a sphere 20, whereby the surface of said sphere is uniformly divided into spherical squares 22 and spherical hexagons 24. With the surface of the sphere so divided, a plurality of great circle paths 26 is symmetrically projected onto the surface. Preferably, the total number of great circle paths 26 is four, with each great circle bisecting two sides of six spherical hexagons 24 projected onto the surface of the sphere. It is also preferred that the great circle paths 26 do not intersect any of the sides of the six spherical squares 22. This synchroneous interlacing of great circle paths 26 through the spherical hexagons 24 and around the spherical squares 22 is clearly shown in FIGS. 3 and 4.

Figure 5:
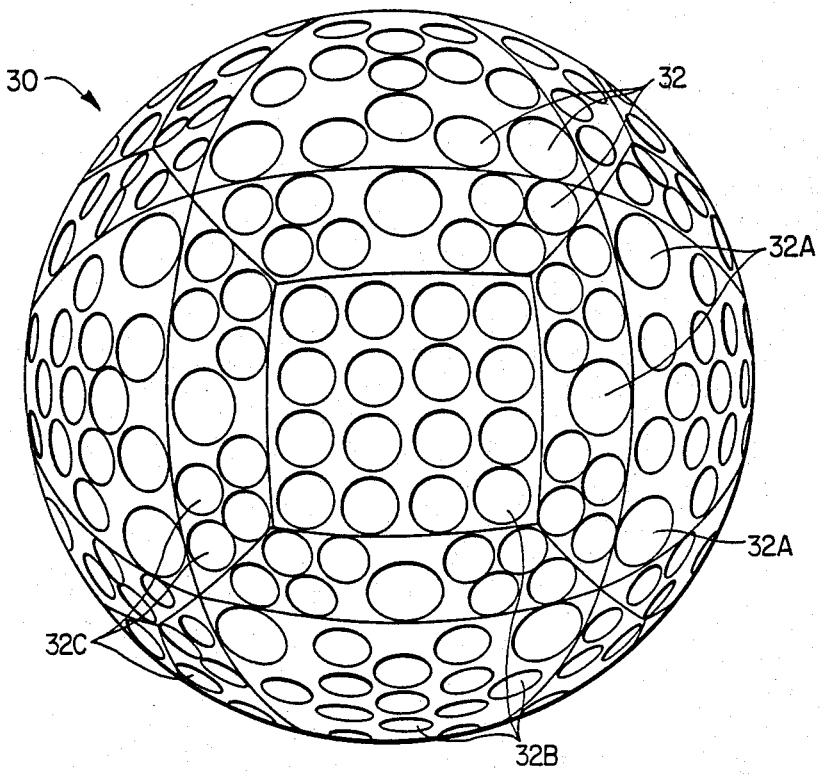
FIG. 5 is a front elevational view of a golf ball showing the arrangement of dimples in accordance with the preferred embodiment of the present invention, with the corresponding geometric shapes and great circle paths being inscribed thereon.
Figure 6:
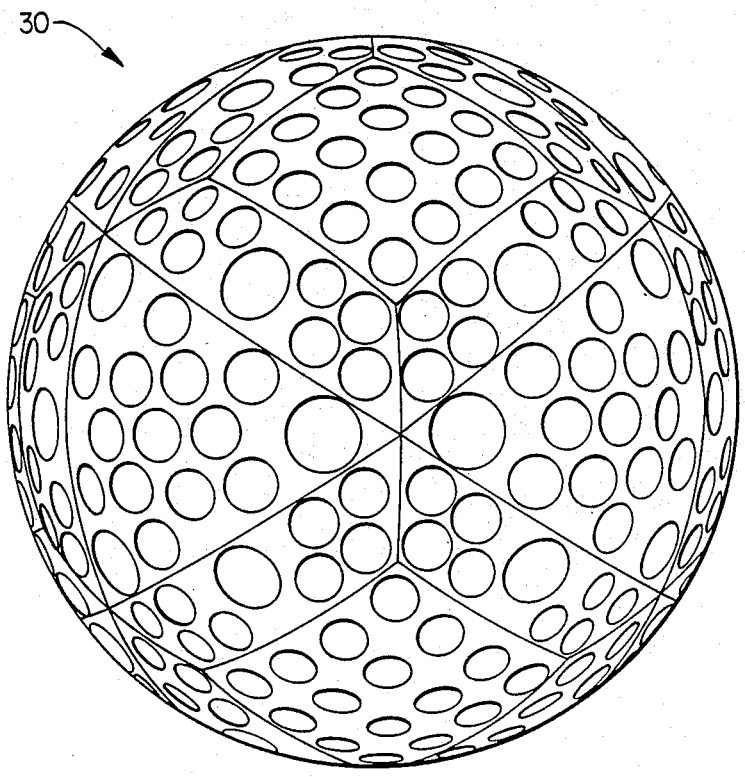
FIG. 6 is a side elevational view of the golf ball of FIG. 5, also depicting the geometric shapes and great circle paths.

The preferred embodiment of the present golf ball is identified by numeral 30 in FIGS. 5 and 6. Referring now to FIGS. 5 and 6, the external surface of golf ball 30 has a plurality of dimples 32 formed therein, dimples 32 being disposed within the boundaries of spherical squares 22 and spherical hexagons 24. Preferably, for any given spherical square 22 or spherical hexagon 24, the arrangement of dimples 32 therein is generally uniform. When used in this context, uniformity means that, if a dividing line is arbitrarily drawn through any given spherical square 22 or hexagon 24 whereby the sides of said spherical square or hexagon are substantially symmetric about said dividing line, the dimples 32 disposed within said spherical square or hexagon are likewise symmetric about said dividing line. It is also preferred that the arrangement of dimples 32 within any given spherical square 22 be identical to the arrangement of dimples 32 in the remaining spherical squares 22. Similarly, the arrangement of dimples 32 within a given spherical hexagon 24 is preferably identical to the arrangement of dimples 32 in the remaining spherical hexagons 24.

The uniformity and repetition of the arrangement of dimples 32, in conjunction with the unique combination of spherical squares 22 and spherical hexagons 24, provide the unusually high degree of symmetry found in golf balls made in accordance with the teachings of this invention. At least seven axes of symmetry are present in the preferred embodiment described herein, an axis of symmetry being defined as a line passing through the center of the golf ball about which the golf ball may be rotated to produce substantially equivalent aerodynamic effects on either side of a plane bisecting the golf ball and perpendicular to said line. It will be understood to those skilled in the art that an axis passing through the geometric center of any given spherical square 22 or spherical hexagon 24 will constitute an axis of symmetry. Additional axes of symmetry will exist depending upon the particular arrangement of dimples 32 selected by the manufacturer.

As shown in FIGS. 5 and 6, golf ball 30 incorporates three different sizes of dimples 32, the different sizes being identified by labels 32A, 32B, and 32C. Additionally, dimples 32 are disposed on the preferred embodiment such that none of dimples 32 intersect any of the boundary lines defining spherical squares 22 and spherical hexagons 24. It is contemplated, however, that dimples 32 may be formed in any number, size or sizes suitable for the purpose, and that one or more of dimples 32 may intersect one or more boundary lines defining the spherical squares and hexagons without departing from the scope of the present invention.

Figure 7:
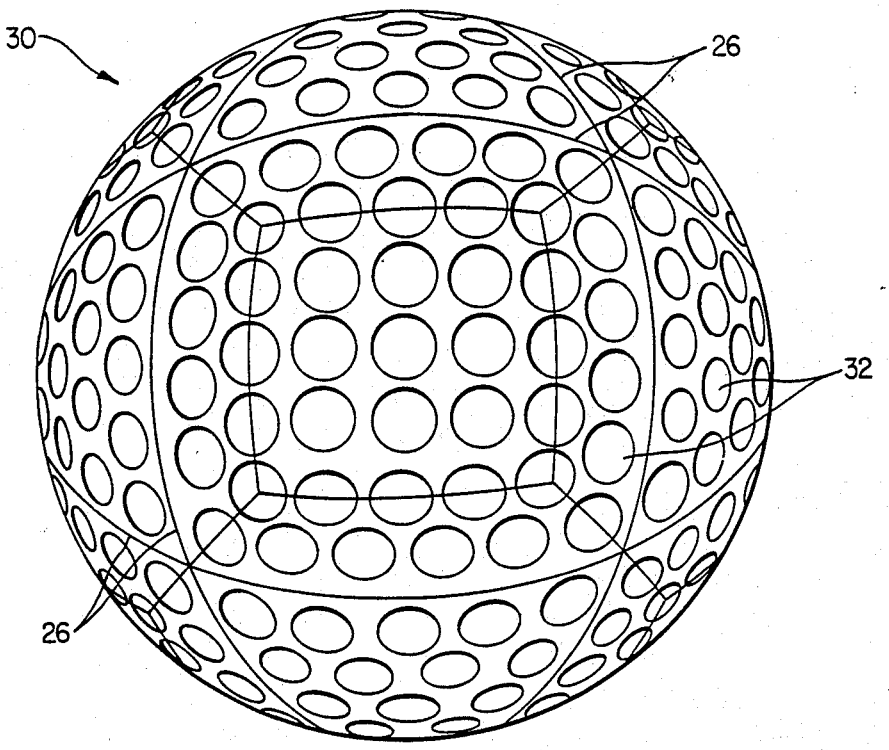
FIG. 7 is a front elevational view of an alternative embodiment of the golf ball of the present invention, with the dimple arrangement, geometric shapes, and great circle paths being inscribed thereon.
Figure 8:
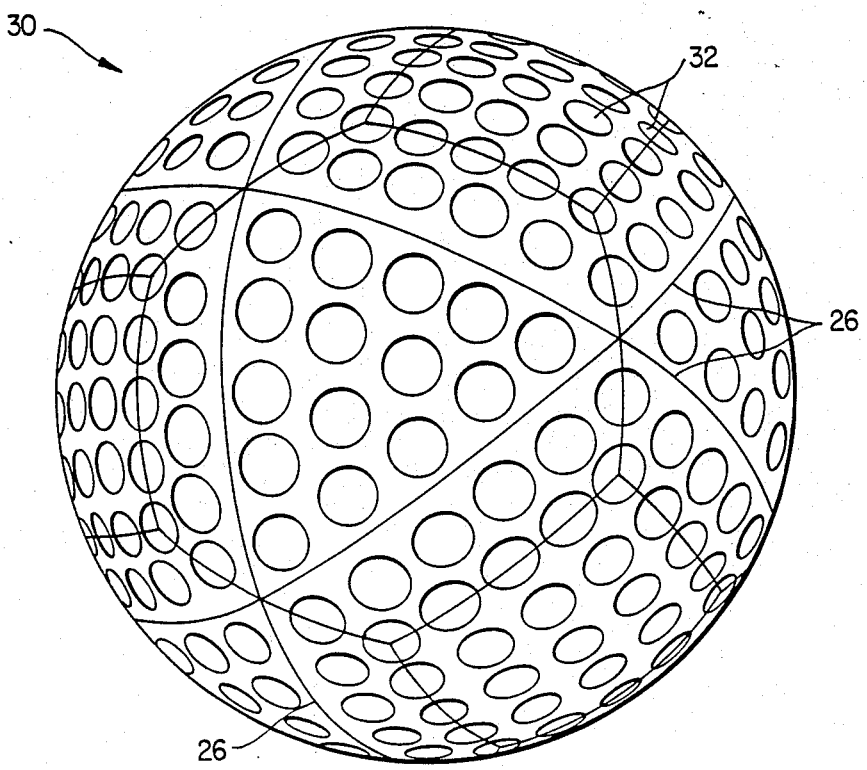
FIG. 8 is a side elevational view of the alternative embodiment shown in FIG. 7.

FIGS. 7 and 8, for example, depict an alternative embodiment of golf ball 30 wherein dimples 32 are all of uniform size and shape, and certain dimples 32 intersect the boundary lines between adjacent hexagons.

FIGS. 5 and 6 also disclose the preferred placement of great circles paths 26. With great circle paths 26 disposed as shown, dimples 32 may be conveniently located so that none of dimples 32 intersect great circle paths 26. This is an important feature of the present invention, since great circle paths 26 represent possible parting lines between the two hemispheres of the golf ball cover. The unique placement of great circle paths 26 disclosed herein provides for the uniform and symmetric distribution of the smooth surfaces naturally caused by the parting line during assembly of the golf ball. Rather than incorporating a single smooth equator, or a plurality of smooth equators disposed about a single axis of symmetry, golf ball 30 includes multiple smooth equators uniformly distributed around multiple axes of symmetry. The novel combination of spherical squares and hexagons synchronously interlaced with four great circle paths as disclosed herein results in the uniform distribution of both dimples and smooth spots about multiple axes of symmetry.

As evident from the above detailed description, the golf ball of the present invention has a degree of symmetry heretofore unknown in the prior art. Since symmetry is a significant factor in the overall performance and U.S.G.A. qualification of a golf ball, the present invention provides a golf ball with superior aerodynamic qualities and more consistent performance than prior art devices. It is believed that golf balls formed in accordance with the teachings of this invention will fly more accurately and at least as far as any prior art golf balls regardless of ball orientation upon contact with the golf club.

The preferred method of manufacturing the golf ball of this invention is to utilize a two piece construction, as described hereinabove, with a synthetic thermoplastic cover injection molded around a solid core. The dimple pattern disclosed herein is especially well suited for the placement of location pins for injection molding wherein six pins may be located in the center of six dimples 32A. It will be clear to one skilled in the art that the teachings of this invention are equally applicable to golf balls of any conventional construction and material.

While the principle of the arrangement of dimples has been made clear, it will be immediately apparent to those skilled in the art that there are many possible modifications to the disclosed arrangement without departing from the basic spirit of the present invention. Accordingly, the following claims are intended to cover and embrace not only the specific embodiment disclosed herein, but also such modifications with the spirit and scope of this invention.

What is claimed is:

1. A golf ball having a spherical surface with a plurality of dimples formed therein and four great circle paths which do not intersect any of said dimples, said dimples being arranged by dividing said spherical surface into six identical spherical squares and eight identical spherical hexagons, and said dimples being organized in discrete groups, wherein at least a major portion of the dimples in each group are positioned within a different one of said spherical squares and spherical hexagons.

2. The golf ball according to claim 1 wherein:

all of said dimples are formed within the boundaries of said spherical squares and hexagons so that said dimples do not intersect the sides of any of said spherical squares and hexagons.

3. The golf ball according to claim 1 wherein:

at least one of said dimples intersects at least one side of at least one of said spherical squares or hexagons.

4. The golf ball according to claim 1 wherein:

all of said dimples are of the same approximate size and configuration.

5. The golf ball according to claim 1 wherein:

said dimples are of varying sizes.

* * * * *